US005907996A

United States Patent [19]

Mungenast

[11] Patent Number: 5,907,996

[45] Date of Patent: Jun. 1, 1999

[54] HALF-TONE PRINTING PROCESS

[75] Inventor: Heinz Mungenast, Kufstein, Austria

[73] Assignee: Schablonentechnik Kufstein Aktiengesellschaft, Kufstein, Austria

[21] Appl. No.: 08/833,450

[22] Filed: Apr. 7, 1997

[30] Foreign Application Priority Data

Apr. 19, 1996 [EP] European Pat. Off. ..... 96106202

[51] Int. Cl.[6] ..... B41M 1/12

[52] U.S. Cl. ..... 101/129; 101/484

[58] Field of Search ..... 101/114, 116, 101/129, 181, 183, 211, 365, 128.4, 483, 484

[56] References Cited

U.S. PATENT DOCUMENTS

| | | | |
|---|---|---|---|
| 4,546,700 | 10/1985 | Kishner et al. | 101/211 |
| 4,975,862 | 12/1990 | Keller et al. | 101/365 |
| 5,068,810 | 11/1991 | Ott | 101/211 |
| 5,367,384 | 11/1994 | Sakamoto | 101/492 |
| 5,460,090 | 10/1995 | Pfeiffer et al. | 101/484 |
| 5,740,733 | 4/1998 | Mungenast | 101/116 |

FOREIGN PATENT DOCUMENTS

| | | |
|---|---|---|
| A-2605016 | 2/1976 | Germany . |
| U-8905925 | 5/1989 | Germany . |

*Primary Examiner*—Ren Yan
*Attorney, Agent, or Firm*—Birch, Stewart, Kolasch & Birch, LLP

[57] ABSTRACT

In a half-tone printing process according to the invention, there is provide at least one half-tone printing stencil having at least two regions which have stencil opening structures which are uniform but different from region to region. A sample print is carried out, using such a half-tone printing stencil, to produce printed images associated with the respective regions. A comparison is made of optical data of the respective printed images with corresponding desired values. Readjustment of printing parameters can occur based upon the comparison in such a way that the optical data in the case of the next print approach the corresponding desired values. To this end, there may preferably be an optical measuring device for measuring the optical data in the prescribed regions of the half-tone print, and a control unit altering the printing parameters as a function of the measured optical data.

20 Claims, 5 Drawing Sheets

HALF-TONE PRINTING PROCESS

BACKGROUND OF THE INVENTION

1. Field of the Invention

The invention relates to a half-tone printing process.

2. Description of the Relevant Art

Stencils for textile printing, which apply different quantities of colour per unit area, area by area, induced by the pattern produced (half-tone printing) are generally known. These stencils may be flat stencils or rotary printing stencils. These stencils may be screen-printing stencils, flexographic printing stencils, gravure printing stencils, etc. What is common to them all is that they have in different stencil regions stencil opening structures which are uniform but different from region to region. In the case of screen-printing stencils, in different stencil regions the screen openings of a screen which is coated with covering varnish is covered or exposed to a different extent, in order to achieve different degrees of permeability in the respective regions. However, the screen could also be manufactured from the start in such a way that it has different screen openings in different regions. The latter is also true for the flexographic stencils or gravure stencils also mentioned above, in which however, no through-openings are present. Here, the term screen opening structure refers to the depressions present in the surface of the said stencils.

As an example, let the production of a rotary screen-printing stencil be explained in more detail. Here, it is possible to use a hollow cylindrical round screen which is coated with lacquer and is thus closed and, for example by means of a laser which removes the lacquer coating, can be opened over the entire area or partially. If the lacquer layer can be polymerized, the laser could also be used only for the point by point exposure of the lacquer layer, in order to cure the latter. A development process would then be carried out in order to remove the non-exposed regions of the varnish layer. However, it is also possible to produce a pattern consisting of a large number of small, for example hexagonal, screen points of different size, on a nickel cylinder (hollow cylinder) which is coated with lacquer, by on the one hand removing the lacquer or, on the other hand, by exposing and developing the lacquer. In any case, a laser beam is caused to scan the surface of the screen or of the hollow cylinder, for example following closely adjacent helical lines, and the laser beam is pulsed. In the case of the hollow cylindrical round screen, the varnish is thus removed from the screen cylinder in the form of small openings, and a non-uniform, perforated varnish structure is then overlaid on the uniformly perforated screen. The stencil which is produced in this way can be used directly for printing. In the other case mentioned, of the completely closed cover of a hollow cylinder, a varnish structure or stencil opening structure consisting of a large number of small and separate points is produced by means of the laser beam via the abovementioned processing. These points are produced in different sizes, to be specific from pattern region to pattern region, and the cylinder formed in this way is subjected to a further electroplating process in order to coat it with nickel. In this case, nickel is deposited at the exposed points on the metallic cover of the hollow cylinder, whereas at those points at which a varnish point has remained, a hole is produced in the nickel coating. During this electroplating process, a sleeve or electroplated stencil is thus obtained having openings distributed in accordance with the pattern and of different diameters in different pattern regions, for which reason different amounts of ink pass through the respective pattern regions later during printing.

In the case of the varnished stencils, the different permeability of the stencil regions is produced by means of on times or off times of different lengths of the engraving laser beam.

Stencils of the type mentioned above can also be produced, however, by spraying a liquid onto the stencil base cylinder. In this case, the different permeability of the stencil regions is produced by means of on times or off times of different length of a spraying nozzle which is used. For example, it would be possible by this means to coat a uniformly perforated screen in an appropriate way with covering lacquer, in order immediately to obtain different regions having in each case a different degree of permeability. This is correspondingly true for the coating lacquer layer which is sprayed onto the closed surface of a supporting body for the production by electroplating of a corresponding screen. In the case of a screen, it would also be possible to spray an opaque liquid in pattern onto a polymerizable coating layer, following which large-area exposure is carried out. Following the curing of the non-covered layer regions, a development process would then be carried out.

One of the difficulties which occurs here is that many settings of operating parameters both on the engraver or laser engraver and also on the printing machine are left to the judgement and the skill of the engraver or of the printer and, as a result, unintentional, severe deviations from the intensity profile aimed at for the half-tone print are produced precisely in the region of the half-tone print. Even if a half-tone stencil has been engraved with the nominally correct opening relationships, that is to say with the nominally correct permeability relationships or degrees of permeability, some of the inks may be applied with the wrong intensity as the result of an unintentionally wrongly set printing machine or one of the printing stations.

In the case of polychromatic printing, in particular, this immediately leads to an appreciable disturbance in the colour reproduction, which simply means that those colours whose correct reproduction is based on the maintenance of exact quantity relationships of the individual components are completely wrongly reproduced in terms of colour.

SUMMARY OF THE INVENTION

The invention is based on the object of specifying a half-tone printing process with which half-tone prints may be carried out in a fault-free and true-to-colour manner. Furthermore, it is the aim of the invention to specify a printing machine which is suitable for carrying out this half-tone printing process.

A half-tone printing process according to the invention contains the following steps:

provision of at least one half-tone printing stencil having at least two regions which have stencil opening structures which are uniform but different from region to region;

carrying out a sample print, using such a half-tone printing stencil, to produce printed images associated with the respective regions;

comparison of the optical data of the respective printed images with corresponding desired values; and, if appropriate, readjustment of printing parameters in such a way that the optical data in the case of the next print approach the corresponding desired values.

The stencil opening structures may be such in which screen openings which are already present are covered to a greater or lesser extent by a lacquer layer coming to lie on them. However, the stencil opening structures can also directly be screen openings which have different sizes in each case in the said regions. Finally, stencil opening structures should also be understood to include such recesses or depressions which are located in the surface of a gravure or flexographic printing forme.

The said comparison of the optical data of the respective printed images with the corresponding desired values can be carried out, for example, visually by the printer. It is very simply possible, by placing on a comparison pattern which has the correct optical data. However, the printing machine then has to be stopped for this comparison.

The colour values and/or the colour intensities are preferably used as optical data. They are very easy to register and to assess, even visually.

Developing the invention, the optical data of the respective printed images can also be measured electronically, however, the comparison of the optical data with the corresponding desired values, and the readjustment of the printing parameters also being able to be carried out automatically. This enables uninterrupted operation of the printing machine and thus more rapid starting-up of printing.

In principle, it is possible for the said comparison to use regions within the half-tone pattern to be printed, provided that the position of these regions is known or is prescribed. An optical measuring device for measuring the optical data of the printed images in the respective regions would then have to be moved into these regions.

Developing the invention, the said regions now come to lie outside the actual pattern region of the half-tone printing stencil, so that the corresponding printed images which are associated with these regions are printed outside the actual half-tone patterns. This has the advantage that, given a prescribed position of the said regions or printed images, the optical measuring device can be arranged in a stationary fashion on the printing machine, which simplifies construction of the printing machine.

The said regions outside the actual pattern region of the half-tone printing stencil shall be referred to below as area marks. In these area marks there are therefore in each case stencil opening structures which are uniform but which are different from area mark to area mark. The printed images on the material web which are obtained in each case when using the area marks are referred to below as area mark images. In this case, the area marks can lie directly adjacent to one another or can be arranged separately or at a distance from one another.

Not least, it should be pointed out that it is of course also possible for cylindrical stencils to be used as half-tone printing stencils.

In conjunction with cylindrical half-tone stencils, it is already known to provide printing marks at the front edge of the pattern region. These printing marks have the task of facilitating the registering of the stencils during the start-up phase of a print. During this phase, the motifs printed on a material web by each stencil of a set must be brought into coincidence with one another in terms of their image. In order to be able to carry this out as rapidly as possible, it has always been necessary to observe simple figures, such as, for example, circular rings printing concentrically inside one another. Since an image motif seldom has such figures, the producer of the printing stencil has already previously provided such figures at the edge of the stencil.

According to a variant of the invention, it is now proposed, in addition to the known printing marks (picos) at the edge of the pattern region, also to provide the said area marks or half-tone marks, with which specific, prescribed colour intensities or colours are intended to be achieved when the stencil is used for printing. As already mentioned, these area marks consist of small areas which are engraved with a different but predetermined permeability and which, given correct setting of all the parameters on the printing machine during printing with such a stencil, yield a defined and therefore checkable sequence of colour values and colour intensities from the range from 0 to 100%.

A series of area marks has, for example, different permeabilities or degrees of permeability, for example from the value 10, 25, 50, 75 and 100%. If the colour or colour intensity at these points does not then agree with the defined desired colours or desired intensities, the printer is able to alter the setting parameters of the respective inking unit. Automatic measurement and resetting is also possible, as already mentioned.

In the case where the invention is applied to a printing machine, the printing parameters of an inking unit include the contact pressure of the squeegee, or in the case of wiping squeegees the curvature of the wiping lip, the printing speed, the squeegee diameter, the level of the ink pond and the ink viscosity. In the case of wiping squeegees, their shape, put more precisely the curvature of the wiping squeegee lip, is altered by more intense or less intense pressure of the squeegee on the ends of the stencil. In the case of printing machines having magnetic pulling of the squeegee, the contact pressure of the roller squeegee can be altered by reinforcing or weakening the magnetic field. However, the diameter of a roller squeegee, that is to say its shape, can only be altered by exchanging the squeegee itself. Changing the viscosity of the ink paste is generally the most complicated, since this mostly requires complete cleaning of the printing station.

In order to be able to engrave a half-tone pattern correctly, a test half-tone print is firstly prepared by means of a sequence of sample prints using engravings which have different permeabilities. This test half-tone print is subsequently measured, that is to say the intensity of the application of ink is determined, and the position of the colour value in a colour system which is suitable for determining the colour is established. Such colour systems are known and standardized, for example under DIN 5033 and DIN 6164. This sample print is expediently carried out on a printing machine which is either from the start the later production machine or at least corresponds to the latter in terms of construction. The type of engraving of the test stencils will also correspond to the type of engraving of the production stencils being considered. Finally, the test prints are prepared in such a way that the setting parameters mentioned earlier of the printing machine are varied in steps within prescribed limits. During the evaluation of such test prints, tabular associations are obtained between colour intensities and opening relationships of the engraving. However, specific values of the setting parameters specified above also belong to each table.

For the production of a set of printing stencils, with which a half-tone pattern is intended to be produced, the one selected from the table set up will be that from which both a sufficient breadth of variation of the colour intensities achieved as a function of the engraving opening relationship proceeds, and from which it can also be seen that, by varying the setting parameters of the printing machine, a further additional alteration of the colour intensities in the direction of lower and higher intensities is possible. Area marks are thus provided on each of the stencils thus produced, each of the area marks having a uniform permeability, but this permeability differing from that of the next area mark.

If a printing machine is then equipped with this set of stencils and printing has begun, then it is best if the colour value and the colour intensity, respectively, of the print under the area marks is either read immediately after each stencil by a reading device (video camera, colour scanner), or at the latest at the end of the machine, that is to say at the machine outlet, by a measuring device which is provided jointly for all the printing stations. As already mentioned, however, an experienced printer can also be estimate the colour deficiency visually and undertake a correction of the printing parameters by hand. This may possibly take place with the aid of a comparison pattern. The measurement of the colour deficiency by machine and the computer-controlled processing of this measurement result will be provided if the printing machine is equipped in such a way that at least some of the said setting parameters can be altered by servo mechanisms or adjusting motors.

For the case in which there are no area markers at the edge of the stencil, and regions of the actual stencil pattern are intended to serve as a substitute for these area marks, the measuring device must be arranged movably on the printing machine in order to be able to measure the printed images printed with these regions. The travel of the said measuring device can then be set under computer control.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
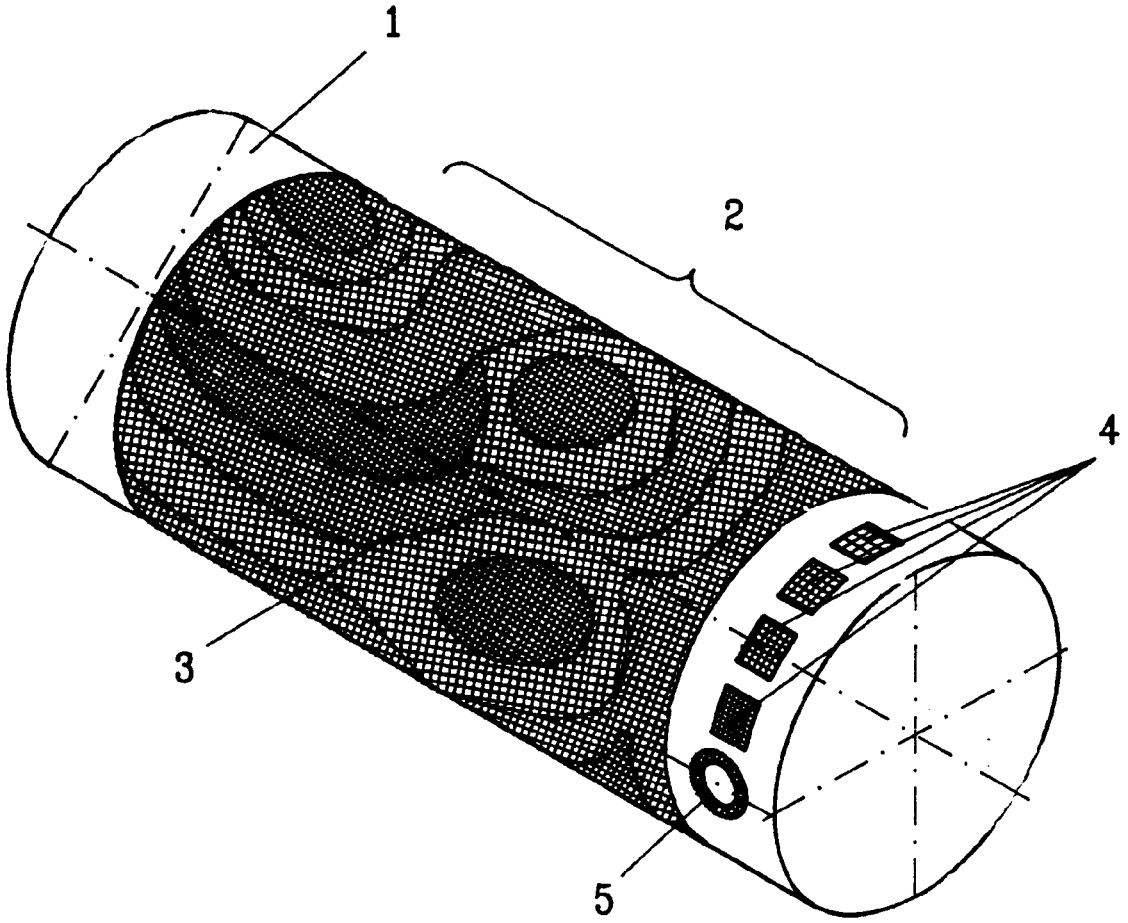
FIG. 1 shows a half-tone rotary printing stencil used for carrying out the process according to the invention.

FIG. 1 shows a half-tone rotary printing stencil 1 which is equipped in its central part 2 with a pattern engraving 3 which has different permeability relationships in different regions. At the front edge of the half-tone rotary printing stencil 1 there is located a plurality of area marks 4, which are separate here, each of which has a uniform permeability, but the permeabilities differ from area mark 4 to area mark 4. In this case, however, the permeabilities of the area marks 4 do not have to be identical with precisely those permeabilities which occur in the pattern engraving 3. The area marks 4 are nothing other than prescribed engraving regions in which there are stencil openings of a size which are smaller than a standard size. If, for example, the half-tone rotary printing stencil 1 consists of a cylindrical screen whose uniform screen structure is covered by a lacquer layer, then in the region of the area marks 4 the screen openings are in each case covered to a different extent by the lacquer layer, in order to achieve different permeabilities in different area marks 4. In addition, a further printing mark 5 (pico) is provided, which is embodied here by a circular ring and which serves to make it easier to carry out in-register printing of stencils 1 arranged one after the other on a printing machine. This printing mark 5 also lies at the front edge of the half-tone rotary printing stencil 1, outside the pattern engraving 3.

If a sample print is carried out using such a half-tone rotary printing stencil 1, a comparison standard can be held against the printed area marks 4 for the purpose of visual assessment of the engraving, said comparison standard consisting, for example, of material printed with a correct tonal value. In the case of such a visual comparison, it is of course necessary for the printing machine to be stopped. If it emerges from this that the printed area marks 4, that is to say the respective printed images of the area marks 4, differ from the respective comparative standard, then printing parameters are readjusted appropriately in such a way that in the case of the next print the printed area marks are better in agreement with the respective comparative standards.

Figure 2:
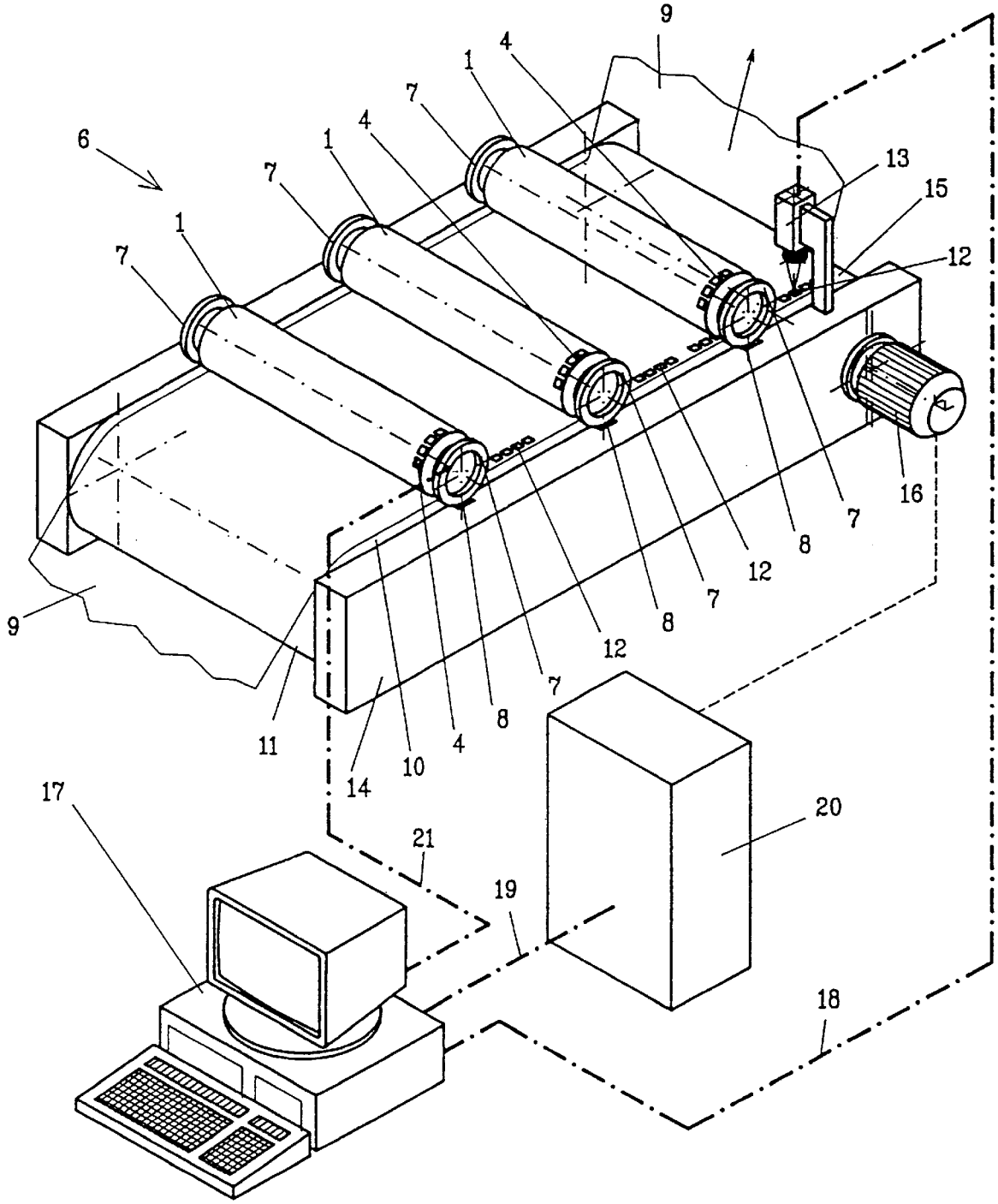
FIG. 2 shows a rotary printing stencil printing machine according to the invention.

Shown in FIG. 2 is a rotary screen-printing machine 6 on which a plurality of stencils 1 equipped according to FIG. 1 are used. In the case of such a machine 6, the stencils 1 are driven via gearwheels 7 and repetition gearing 8, so that the said stencils run synchronously with the material web 9 and the underblanket 10, respectively, which are led through the machine 6 underneath the stencils 1. The gearwheels 7 are fastened to the heads of the stencils, which are bonded into the end of the stencils 1. The material web 9 is bonded onto the underblanket 10 with a very easily detachable adhesive and the web is therefore held firmly by the underblanket 10 during the printing. The underblanket 10 is a very wide rubber fabric conveyor belt with a very smooth surface and with a flexural behaviour which is as uniform as possible across the width. This underblanket 10 runs over two deflection rolls 11 and 15, around which the underblanket 10 wraps. The rear deflection roll 15 is driven by a DC motor 16. This deflection roll pulls the underblanket 10 through beneath the stencils 1. The front deflection roll 11 is driven by the underblanket 10. Deflection roll 11 drives the individual repetition gears 8 via spur-wheel gearing which is concealed by the side wall 14 and a likewise concealed intermediate shaft. This arrangement achieves the synchronous running mentioned between stencils 1 and material web 9 to be printed. The area marks 4 of each stencil 1 are printed together with the pattern onto the material web 9, resulting in area mark images 12. A video camera 13 is mounted at the end of the printing machine 6 on its side wall 14 and continuously measures the color values and color intensities of the area mark images 12. The video images which are picked up are sent to a computer 17 via a data line 18. If a deviation in the shade or in the color intensity is determined by the computer 17, then either an adjustment is made, via the signal line 19, to a controller 20 which influences the speed of the DC motor 16, or influence is exerted via the signal line 21 on a servo mechanism which alters the position or the contact pressure of one of the squeegees mounted in the stencils 1.

Figure 3:
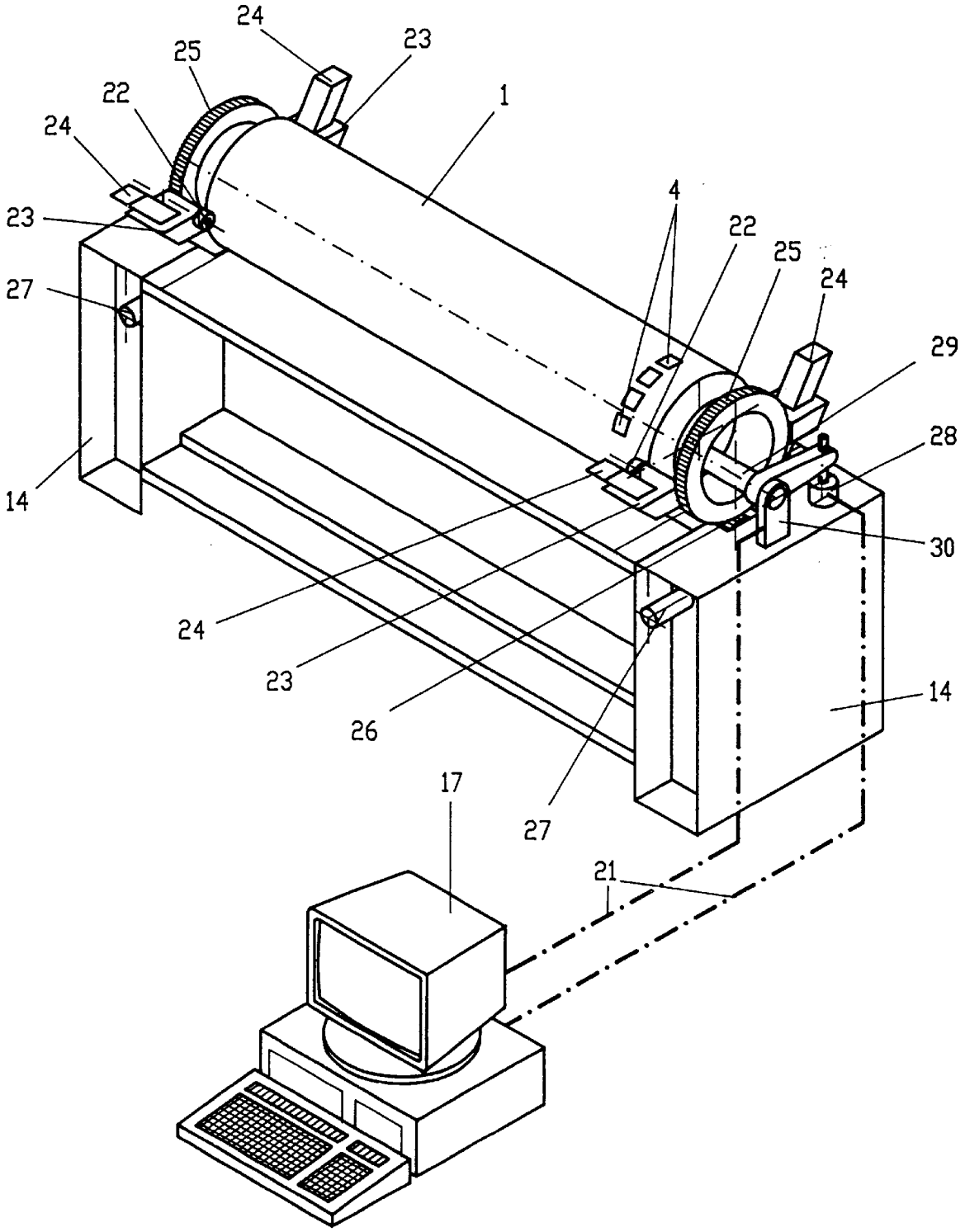
FIG. 3 shows an individual inking unit of the printing machine according to FIG. 2.

Shown in FIG. 3 is a single inking unit of the rotary screen-printing machine 6. In this example, too, the stencil 1 is equipped with area marks 4. Small rollers 22 support the stencil 1 in its ends in such a way that the stencil 1 cannot change its position in relation to the machine 6. These rollers 22 are supported in small roller blocks 23, which can be adjusted along sliding guides 24 and thus set to different stencil diameters. At the two outer ends of the stencil 1, gearwheels 25 are pushed onto the stencil 1 and connected to it in a rotationally fixed manner. Repetition gears are accommodated on both sides of the machine 6 in the side walls 14. Of these gears, however, only the gearwheel 26 which meshes with the stencil 1 is to be seen. In the longitudinal direction of the machine 6, more precisely in the transport direction of the underblanket 10 and of the material web 9, there run the intermediate shafts 27. Above the right-hand side wall 14 there is a servo mechanism 28 for pivoting a squeegee 29 provided in the stencil 1. A bearing block 30 of this squeegee 29 can also be adjusted by a servo mechanism in the vertical direction. In each case signal lines 21, which comes from the computer 17 and via which the required adjusting commands can be fed to the two servo mechanisms leads to both devices.

Figure 4:
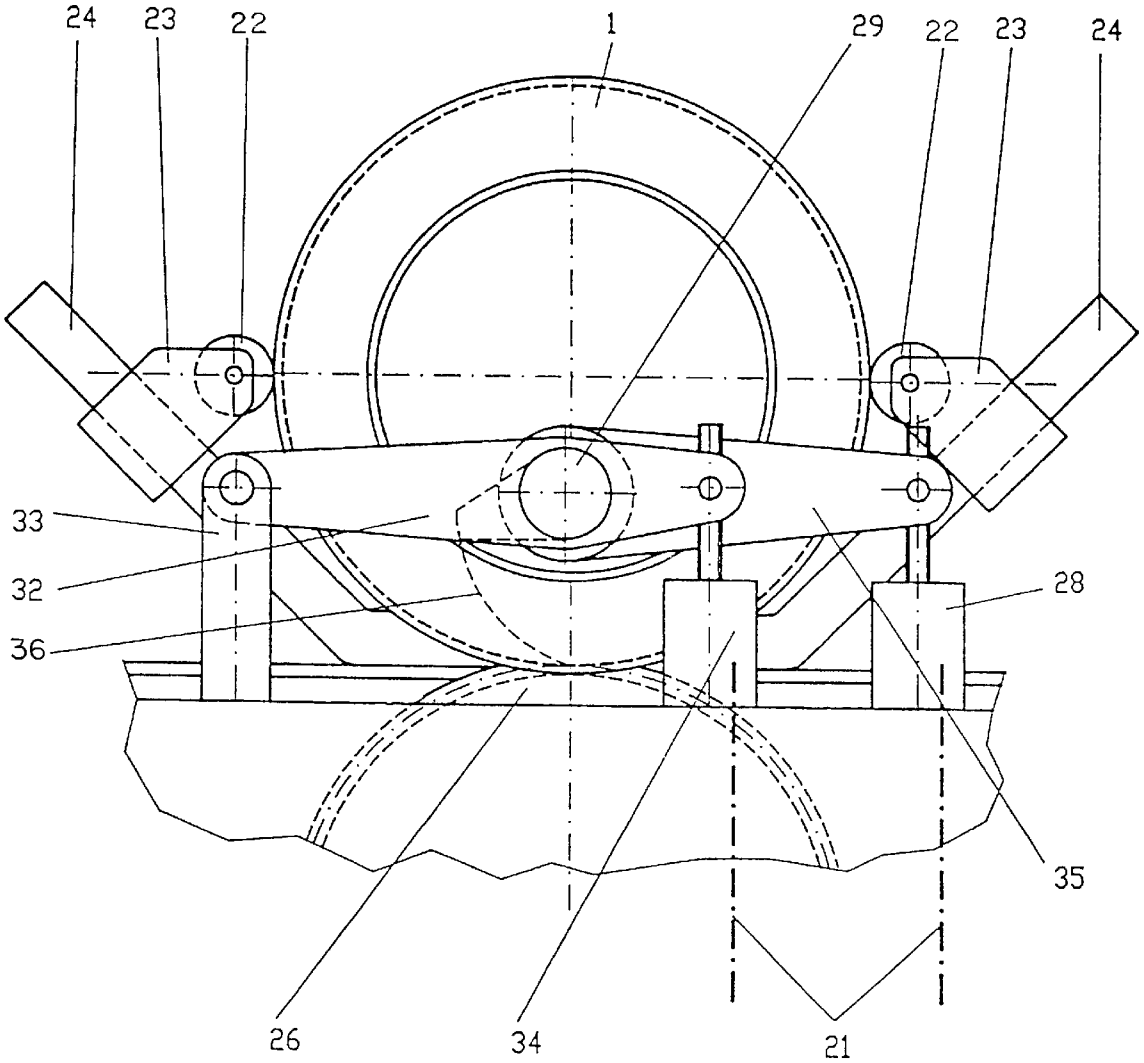
FIG. 4 shows details of the inking unit according to FIG. 3.

The same designations apply in FIG. 4 as in FIG. 3. The height adjustment of the squeegee 29 is undertaken by a double rocker 32, which is rotatably held at its left-hand end in a fixed bearing block 33, and whose right-hand end can be raised or lowered by the servo mechanism 34. The servo mechanism 28 engages on the projecting end of a single rocker 35. If this end is raised or lowered by the servo mechanism 28, then the squeegee 29, which is rotatably mounted in the double rocker 32, is pivoted. Fastened to the squeegee 29 is the thin, deformable squeegee blade 36. If the squeegee 29 is lowered, then the curvature of the squeegee blade 36 changes, above all the wedge angle which is enclosed between the end of the squeegee blade 36 and the stencil 1. By pivoting the squeegee 29, it is primarily possible for the zone of the ink exit from the stencil 1 to be displaced forwards or backwards in its direction of rotation. Both parameters influence the amount of colorant which emerges from the stencil 1 and, respectively, penetrates into the material web 9. The outer diameter of the stencil 1 corresponds to the pitch circle diameter of the gearwheel 25 which is pushed onto the stencil 1 and meshes with the gearwheel 26 of the repetition gearing.

Figure 5:
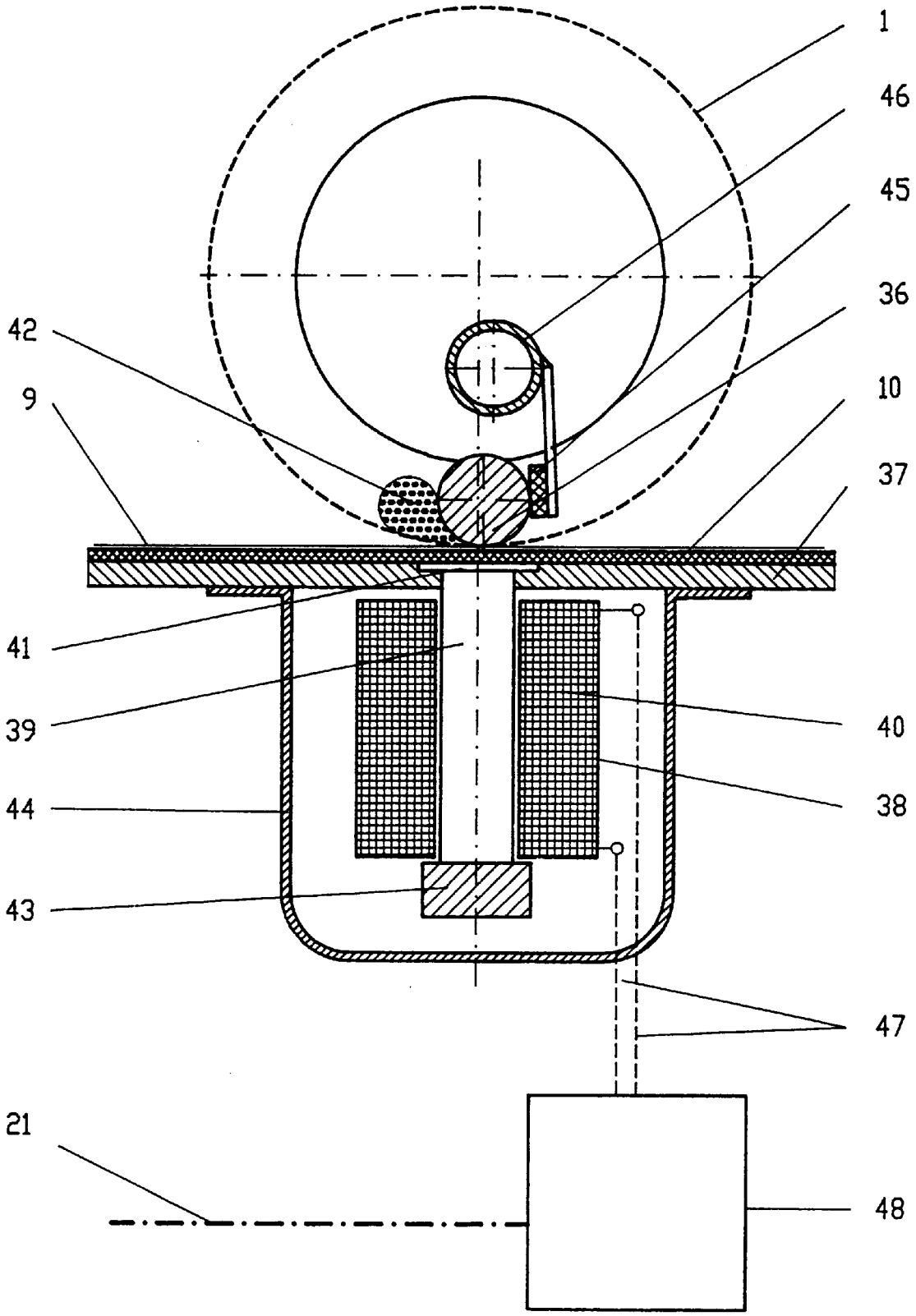
FIG. 5 shows a further embodiment of an inking unit.

Shown in FIG. 5 is the cross-section of a rotary screen-printing station, in which a squeegee roller 36 in the interior of a stencil 1 is pressed by electromagnets 38 against the inner wall of the stencil 1, as a result of which the latter is in turn pressed onto the material web 9 and the underblanket 10. The underblanket 10 runs above a printing table 37. The ends of the cores 39 of the electromagnets 38 open into a groove 41 in the printing table 37, in order that during heating and the expansion caused thereby, they do not project unevenly from below against the underblanket 10 and cause a strip-like accumulation of ink; this is because heating up by the winding elements 40 is unavoidable in this type of construction. Electrically, the winding element 40 is connected via the feedlines 47 to a variable-voltage DC source 48. Upstream of the squeegee roller 36, ink is present in the form of a pond 42. Liquid ink from the pond 42 is drawn, by the moving wall of the stencil 1 and likewise by the wall of the squeegee roller 36, which likewise generally rotates, into the conical gap between squeegee roller 36 and stencil 1, and is pressed into the material web 9 through the openings caused by the pattern in the stencil 1. In order that a high magnetic flux is conducted with as little resistance as possible and free of scattering through the magnetic squeegee roller 36, the magnets 38 which are arranged in the longitudinal direction of the stencil 1 are alternately polarized and are connected at their lower ends by a magnetic yoke 43. The hollow support 44 is used for the static stiffening of the printing table 37. This hollow support and the printing table 37 are produced from a magnetically non-conductive material, for example aluminium. The squeegee roller 36 is held in its position by a stop strip 45, the liquid pressure produced in the ink pond 42 and the magnetic forces. This position can be altered slightly by pivoting the holding tube 46. The magnetic forces in this arrangement determine the force with which the roller squeegee 36 is pulled against the wall of the stencil 1. The slippage of the squeegee roller 36 in relation to this wall is then also set by this magnetic force. The higher the magnetic force, the lower is the slippage, that is to say the difference in speed between roller squeegee 36 and stencil wall. The width of the gap at the narrowest point between squeegee 36 and stencil wall is also strongly influenced by this force, and the level of the hydrodynamic pressure which is built up is determined thereby. Likewise, however, the compression of the material web 9 is also influenced, and hence the flow resistance which is presented by the material web 9 against the penetration of the colorant.

The various influencing factors interact in a very complex way, just as in the case of the squeegee pressure, but it is always possible, by altering the magnetic contact pressure of a roller squeegee or the curvature of a squeegee blade, the position of the squeegee roller or of the squeegee blade and the printing speed, to alter the amount of colorant which emerges from the stencil 1 and penetrates into the material web 9, and hence to control the accumulation of ink in a half-tone print or in a polychromatic print.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A half-tone printing process comprising the steps of:

providing a half-tone printing stencil;

providing a first region on the stencil, the first region having first opening structures to define a desired image;

providing a second region on the stencil, the second region having second opening structures to define a first uniform pattern;

providing a third region on the stencil, the third region having third opening structures to define a second uniform pattern different from the first uniform pattern;

operating the stencil to cause ink to flow through the first, second and third opening structures;

printing the desired image, the first uniform pattern and the second uniform pattern onto a material;

comparing the first uniform pattern and the second uniform pattern with a first reference pattern and a second reference pattern, respectively; and returning to said operating step if said comparing step yields a predetermined likeness, and if said comparing step does not yield a predetermined likeness, adjusting print parameters of the stencil so that the next printing of the first and second uniform patterns will approach a likeness of the first and second reference patterns, and returning to said operating step.

2. The half-tone printing process according to claim 1, wherein said comparing step is performed electronically.

3. The half-tone printing process according to claim 2, wherein said comparing step and said adjusting step are performed automatically.

4. The half-tone printing process according to claim 3, wherein said comparing step includes evaluating color values of the first uniform pattern versus the first reference pattern and evaluating color values of the second uniform pattern versus the second reference pattern.

5. The half-tone printing process according to claim 4, wherein the stencil is shaped as a cylinder, and said step of operating includes rotating the stencil.

6. The half-tone printing process according to claim 3, wherein said comparing step includes evaluating color intensities of the first uniform pattern versus the first reference pattern and evaluating color intensities of the second uniform pattern versus the second reference pattern.

7. The half-tone printing process according to claim 6, wherein the stencil is shaped as a cylinder, and said step of operating includes rotating the stencil.

8. The half-tone printing process according to claim 3, wherein the stencil is shaped as a cylinder, and said step of operating includes rotating the stencil.

9. The half-tone printing process according to claim 2, wherein said comparing step includes evaluating color values of the first uniform pattern versus the first reference pattern and evaluating color values of the second uniform pattern versus the second reference pattern.

10. The half-tone printing process according to claim 9, wherein the stencil is shaped as a cylinder, and said step of operating includes rotating the stencil.

11. The half-tone printing process according to claim 2, wherein said comparing step includes evaluating color intensities of the first uniform pattern versus the first reference pattern and evaluating color intensities of the second uniform pattern versus the second reference pattern.

12. The half-tone printing process according to claim 11, wherein the stencil is shaped as a cylinder, and said step of operating includes rotating the stencil.

13. The half-tone printing process according to claim 2, wherein the stencil is shaped as a cylinder, and said step of operating includes rotating the stencil.

14. The half-tone printing process according to claim 1, wherein said comparing step includes evaluating color values of the first uniform pattern versus the first reference pattern and evaluating color values of the second uniform pattern versus the second reference pattern.

15. The half-tone printing process according to claim 14, wherein the stencil is shaped as a cylinder, and said step of operating includes rotating the stencil.

16. The half-tone printing process according to claim 1, wherein said comparing step includes evaluating color intensities of the first uniform pattern versus the first reference pattern and evaluating color intensities of the second uniform pattern versus the second reference pattern.

17. The half-tone printing process according to claim 16, wherein the stencil is shaped as a cylinder, and said step of operating includes rotating the stencil.

18. The half-tone printing process according to claim 1, wherein the stencil is shaped as a cylinder, and said step of operating includes rotating the stencil.

19. The half-tone printing process according to claim 1, wherein the first region includes the second and third regions, so that after said printing step, the desired image printed on the material will include the first uniform pattern and the second uniform pattern.

20. The half-tone printing process according to claim 1, wherein the second and third regions are separate from the first region and from each other, so that after said printing step, the first uniform pattern and the second uniform pattern will be printed on the material remotely from the desired image.

* * * * *